US010910715B2

(12) United States Patent
Rutfors

(10) Patent No.: US 10,910,715 B2
(45) Date of Patent: Feb. 2, 2021

(54) ANTENNA ARRANGEMENT AND A DEVICE COMPRISING SUCH AN ANTENNA ARRANGEMENT

(71) Applicant: PROANT AB, Umea (SE)

(72) Inventor: Tomas Rutfors, Holmsund (SE)

(73) Assignee: Proant AB, Umea (SE)

( * ) Notice: Subject to any disclaimer, the term of this patent is extended or adjusted under 35 U.S.C. 154(b) by 12 days.

(21) Appl. No.: 16/487,465

(22) PCT Filed: Feb. 27, 2018

(86) PCT No.: PCT/EP2018/054758
§ 371 (c)(1),
(2) Date: Aug. 21, 2019

(87) PCT Pub. No.: WO2018/154132
PCT Pub. Date: Aug. 30, 2018

(65) Prior Publication Data

US 2019/0393603 A1 Dec. 26, 2019

(30) Foreign Application Priority Data

Feb. 27, 2017 (EP) ..... 17158217

(51) Int. Cl.
*H01Q 5/335* (2015.01)
*H01Q 9/04* (2006.01)
(Continued)

(52) U.S. Cl.
CPC ..... *H01Q 5/335* (2015.01); *H01Q 1/38* (2013.01); *H01Q 1/48* (2013.01); *H01Q 9/045* (2013.01)

(58) Field of Classification Search
CPC ..... H01Q 1/36; H01Q 1/38; H01Q 13/08; H01Q 13/085; H01Q 13/10; H01Q 13/103;
(Continued)

(56) References Cited

U.S. PATENT DOCUMENTS 7,872,605 B2 * 1/2011 Baliarda ..... H01Q 13/10 343/700 MS
8,884,835 B2 * 11/2014 Pelosi ..... H01Q 1/521 343/848
(Continued)

FOREIGN PATENT DOCUMENTS

KR 2013 0106652 9/2013
WO WO 00/69021 11/2000

*Primary Examiner* — Jason Crawford
(74) *Attorney, Agent, or Firm* — Mark P. Stone

(57) ABSTRACT

The invention concerns an antenna arrangement (1) comprising: —a printed circuit board (2) having a metallised area (3) acting as a ground plane (3) in use, —a recess portion (4) in an edge portion of the ground plane (3), —a first electrically reactive network (9) bridging the recess portion (4)—a second electrically reactive network (16) bridging the recess portion (4), separately from the first electrically reactive network (9), wherein an electrical length of the recess portion (4) is 1/10th of a wavelength of the resonance frequency of the antenna arrangement (1) or less, and wherein a physical distance between the first (9) and second (16) electrically reactive networks (9, 16) is less than 1/12 of a wavelength of the resonance frequency of the antenna arrangement (1). The invention also concerns a device comprising an antenna arrangement (1).

20 Claims, 8 Drawing Sheets

(51) Int. Cl.
*H01Q 1/38* (2006.01)
*H01Q 1/48* (2006.01)

(58) Field of Classification Search
CPC ..... H01Q 13/106; H01Q 9/04; H01Q 9/0407; H01Q 9/0442; H01Q 9/045; H01Q 5/30; H01Q 5/307; H01Q 5/314; H01Q 5/335
See application file for complete search history.

(56) References Cited

U.S. PATENT DOCUMENTS

| | | | | |
|---|---|---|---|---|
| 9,502,773 | B2 * | 11/2016 | Tsai | H01Q 21/28 |
| 2007/0046554 | A1 | 3/2007 | Fukuchi | |
| 2007/0164918 | A1 * | 7/2007 | Kanno | H01Q 1/24 343/767 |
| 2009/0021439 | A1 * | 1/2009 | Kanno | H01Q 3/247 343/767 |
| 2009/0066596 | A1 * | 3/2009 | Fujishima | H01Q 13/10 343/767 |
| 2009/0224996 | A1 * | 9/2009 | Kim | H01P 1/18 343/860 |
| 2010/0219513 | A1 * | 9/2010 | Zhang | H01Q 13/08 257/659 |
| 2014/0062815 | A1 * | 3/2014 | Tsai | H01Q 5/335 343/745 |
| 2014/0062818 | A1 * | 3/2014 | Tsai | H01Q 5/378 343/746 |
| 2014/0062820 | A1 | 3/2014 | Jang | |
| 2019/0013588 | A1 * | 1/2019 | Chang | H01Q 13/08 |

* cited by examiner

ANTENNA ARRANGEMENT AND A DEVICE COMPRISING SUCH AN ANTENNA ARRANGEMENT

FIELD OF THE INVENTION

The invention concerns an antenna arrangement. Further, it concerns a device comprising such an antenna arrangement.

BACKGROUND ART

Introduction

Over the years, very many different antennas and antenna arrangements have been proposed. Generally, some of the characteristics of such antennas that are of interest to improve are: dimensions (size), efficiency and cost.

EP 2704252 (A2) describes an antenna arrangement with a ground plane having a slot. Further, it comprises a feeding element extending across the slot coupled between ground on one side of the slot and a signal source on another side of the slot. The feeding element also comprises a capacitor. With certain capacitance values of the capacitor, size of the slot and feeding position over the slot, a dual band antenna is enabled.

U.S. Pat. No. 6,424,300 B1 describes a notch antenna on a printed circuit board, the notch antenna having two side portions and an RF signal feed electrically connected to each of the side portions and to the RF circuitry. The RF signal feed is in direct physical contact with each of the side portions of the notch. The antenna is configured to resonate as an antenna within a selected frequency band. In one embodiment, the antenna comprises two notches that resonate in different frequency bands.

US 2012/0280890 discloses a capacitive feed type antenna comprising plural radiation electrodes each having a portion connected to a ground electrode. The antenna further comprises a single feeding electrode connected to a feeder circuit. The feeding electrode faces each of the radiation electrodes, thereby causing capacitance to occur between the feeding electrode and each of the radiation electrodes. The plural radiation electrodes and the feeding electrode are provided such that each radiation electrode is capacitively fed by the single feeding electrode, in a capacitive feeding portion in which the capacitance occurs.

Problems with Prior Art Solutions

The aforementioned U.S. Pat. No. 6,424,300 B1 allows for operation in two different bands by providing two notches in a printed circuit board, one for each band. However, for applications where space on the printed circuit board is limited, the extra space required for the second notch may not be feasible to accommodate.

EP 2704252 (A2) enables both single band and dual band operation depending on certain prerequisites. However, the antenna is quite large with a length of 45 to 57 mm. That may exclude the antenna from use in many applications. FIG. 1 depicts schematically the antenna according to EP 2704252 (A2) with a radio circuit 100. According to the document, the dimensions of the ground plane are approximately 108 mm×60 mm. The length of the slot is about 45 mm and the width approximately 0.6 mm. In this configuration, and with the capacitance of the capacitor approximately from 0.5 pF to 1.5 pF, the antenna efficiency of the antenna structure is greater than 49.7% in the first band of 824 MHz to 960 MHz, and is greater than 35.3% in the second band of 1710 MHz to 2170 MHz. The wavelength at 960 MHz is about 31 cm and the wavelength at 2170 MHz is about 14 cm. That is, the antenna structure is about between 1/7 and 1/3 of wavelength.

However, the antenna structure of EP 2704252 (A2) is not well suited for a smaller antenna. For instance, in FIG. 2, the antenna of FIG. 1 is recreated with a smaller slot and the feeding element 110 moved towards the top of the antenna. The dimensions of the slot in FIG. 2 are 6 mm deep and 2 mm wide and the antenna is impedance matched to a frequency of 2.4 GHz. At 2.4 GHz, the wavelength is approximately 12.5 cm. Thus, the antenna in FIG. 2 has the size of about 1/20th wavelength. As can be seen in FIG. 3, which depicts the return loss of the antenna in FIG. 2, the performance is poor. In many designs, it is imperative to keep the antenna arrangement on a circuit board as small as possible in order to provide space for other components and circuits.

US 2012/0280890 is an example of an antenna in the class of 'Chip antennas', where a radiating component, a 'chip', comprises at least parts of the antenna structure. Such chips lend themselves to an easy mounting with an automated machine. However, the chip antenna can be a rather costly component and also have limited performance. Further, a specific layout for the PCB where it is to be mounted is needed for the integration. For today's trend with small products it is important to optimise the antenna to each product in order to get the best possible performance and bandwidth. This is not possible with the chip antenna due to the need for a specific layout of the PCB where it is mounted.

SUMMARY OF INVENTION

Technical Problem

It is an object of the present invention to propose a solution for or a reduction of the problems of prior art.

A main object is consequently to propose an improved antenna arrangement which can be small in size, enable both single band and dual band operation and at the same time provide an economical solution.

Solution to Problem

According to the invention, this is accomplished with an antenna arrangement having the features of claim 1.

This solution mitigates the above problems by providing an extra capacitance connecting across the recess portion of the invention.

The antenna arrangement according to the invention enables a substantial savings in space requirements compared to many versions of the prior art while providing good antenna properties. Especially the depth with which the antenna arrangement cuts into the edge of a circuit board can be kept small, which enables the preserved space of the circuit board of the antenna arrangement according to the invention to be populated with other components and circuitry.

Adding a capacitor across the recess portion could be considered a high band short-circuit and therefore, a dual band antenna should not be possible with this configuration. However, when the capacitance values are modified to be unusually low, a dual mode antenna is possible with this configuration which is quite surprising. Also, a single band configuration is also possible with the same antenna with modified capacitance values.

Further, the antenna arrangement according to the present invention is easier to tune in dual band mode. It turns out that the void between the electrically reactive networks and the void between the electrically reactive network closest to the bottom base side of the recess portion and the bottom base side itself each generally contribute only to the resonance in one of the bands. That is, the first void contributes mostly to the resonance in one band and the second void contributes mostly to the resonance in the second band. This is beneficial, since it is easier to adjust the characteristics of each band. When adjusting the resonance in one void only one band is mostly affected, the other band remains mostly unaffected and vice versa.

The invention further concerns a device comprising an antenna arrangement having advantages corresponding to those of the antenna arrangement.

Further advantageous embodiments are disclosed in the dependent claims.

As a comment, a known antenna structure called the Inverted F-antenna, IFA, may somewhat resemble the present invention. Also, for such IFAs there is a technique called a top load capacitor that involves a capacitor used to lower the resonance frequency of the IFA. Such top load capacitors are situated across a "notch" in the antenna, located near the opening of the notch, and may appear to be similar to the second electrically reactive network comprising the lump series capacitor according to the present invention. However, they are very different from each other. In short, the top load capacitor of the IFA is used with antenna arrangements having the physical size of about ¼ of a wavelength of the resonance frequency of the antenna, while the capacitor of the second electrically reactive network of the present invention is used with an antenna arrangement corresponding to an 1/10th of a wavelength or less. In practice, they yield very different properties.

The common use for top-load capacitors of IFAs is to place them at portions of the antenna having a high electric field to reduce the resonance frequency of the antenna. This means that the top load capacitor normally is placed about ¼ wavelength from a feed portion of the antenna. If the top load capacitor would be placed close to the feed portion, it would lose its frequency controlling properties. On the contrary, the capacitor of the second electrically reactive network of the present invention is located at a distance from the first electrically reactive network that is less than 1/12 of a wavelength of the resonance frequency of the antenna arrangement.

For IFAs, capacitive matching is normally achieved with a shunt capacitor from the RF feed to ground at the RF feed portion of the slot. To achieve a lower resonance frequency by manipulating the feed portion, normally a series inductance is used.

IFA is also a kind of an electrical antenna structure that needs to be placed at a position as far as possible from a ground plane centre for good operation. It needs also to have a depth that is significant compared to the depth of the ground plane and typically has a depth of at least 50% of the ground plane depth and usually more than 75% as apparent from prior art EP 2704252 (A2). In this way it cuts the ground plane in two halves and generate the electric field at a high electric field position, that is, at the sides of the ground plane.

For the miniature recess portion or notch according to the present invention, it is the feed portion/the series reactive network 9 with the series capacitor that is the main frequency controlling component together with the size and shape of the notch. A lower reactive value (higher capacitor value) lowers the resonance frequency. However, due to the small notch size, the antenna arrangement according to the invention has a very low radiation resistance, far from the ordinary 50 ohms match. To match the antenna to 50 ohms, the obvious placement for a matching network is at the feed portion of the RF signal. For a miniature notch, that would involve adding a shunt capacitor to achieve a 50 ohms match. According to U.S. Pat. No. 6,424,300 (B1), the value is about 8 pF at 1575 MHz resulting in only 12 Ohms impedance to ground. This yields a low pass filter that is unwanted in dual band operation when a second higher frequency band is required.

Instead, according to the invention, a separate capacitance over the notch (together with the feeding portion/series reactive network 9) can surprisingly overcome the problem with low pass filtering. Even though the capacitance value needed is very small, it unexpectedly yields a good impedance matching for a miniature notch antenna. And due to the very small value, about 0.2 pF at 2.4 GHz it does not filter out frequencies for dual band 2.4 and 5 GHz operation. Such a small capacitance value results in an impedance of about 300 Ohms at 2.4 GHz and 150 Ohms at 5 GHz. For a larger antenna, such a small component value would have a very limited effect. It seems that the small notch size results in a greater effect for the small reactive values.

BRIEF DESCRIPTION OF DRAWINGS

Embodiments exemplifying the invention will now be described, by means of the appended drawings, on which.

DETAILED DESCRIPTION

Figure 1:
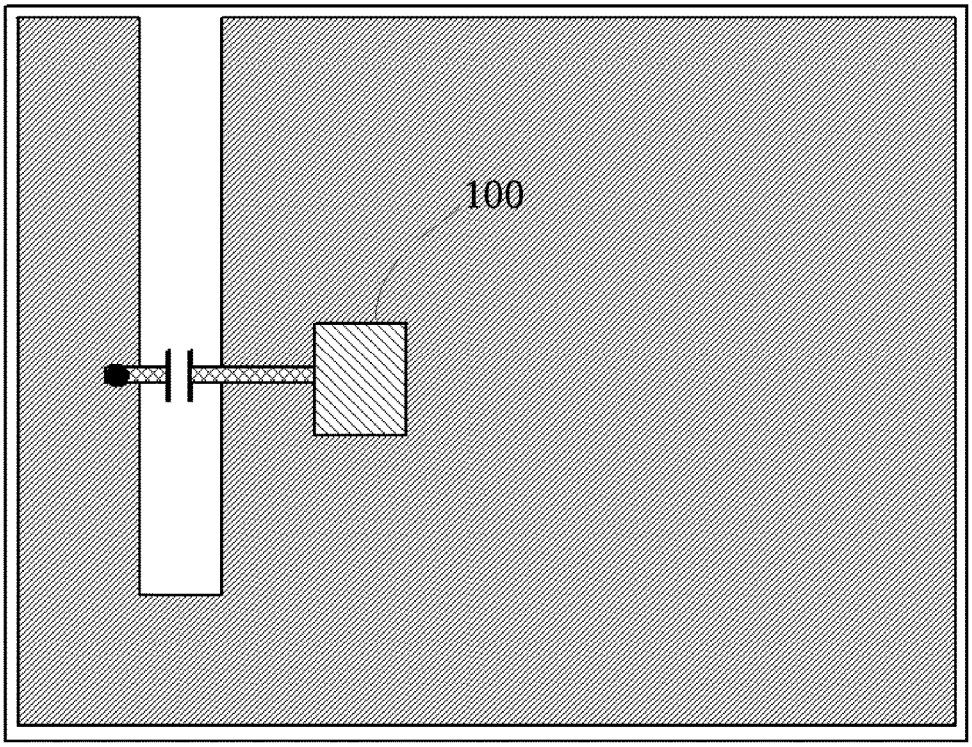
FIG. 1 illustrates an embodiment of prior art.
Figure 2:
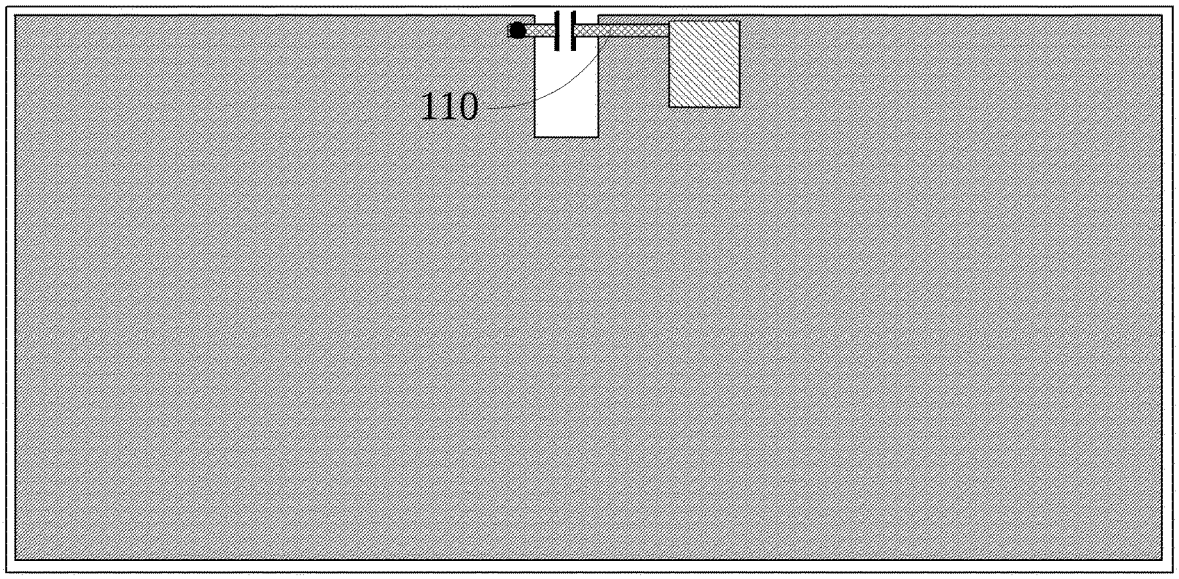
FIG. 2 illustrates a antenna arrangement trying to miniaturise the prior art of FIG. 1.
Figure 3:
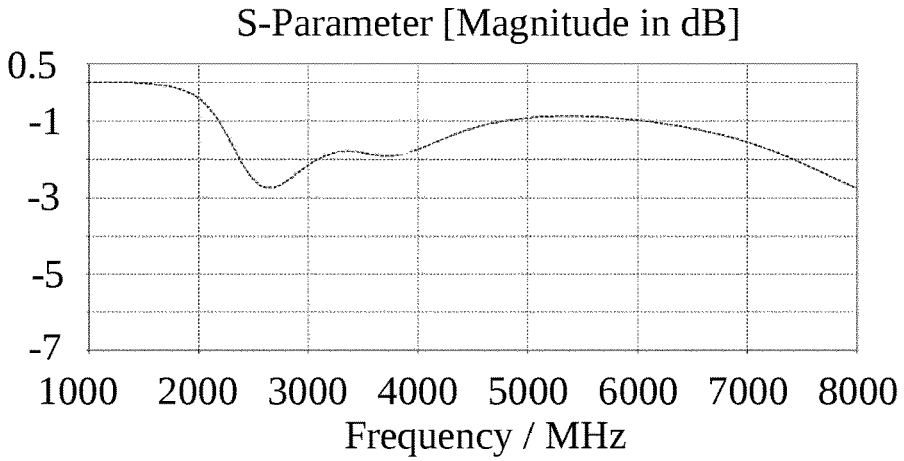
FIG. 3 illustrates a return loss of FIG. 2.
Figure 4:
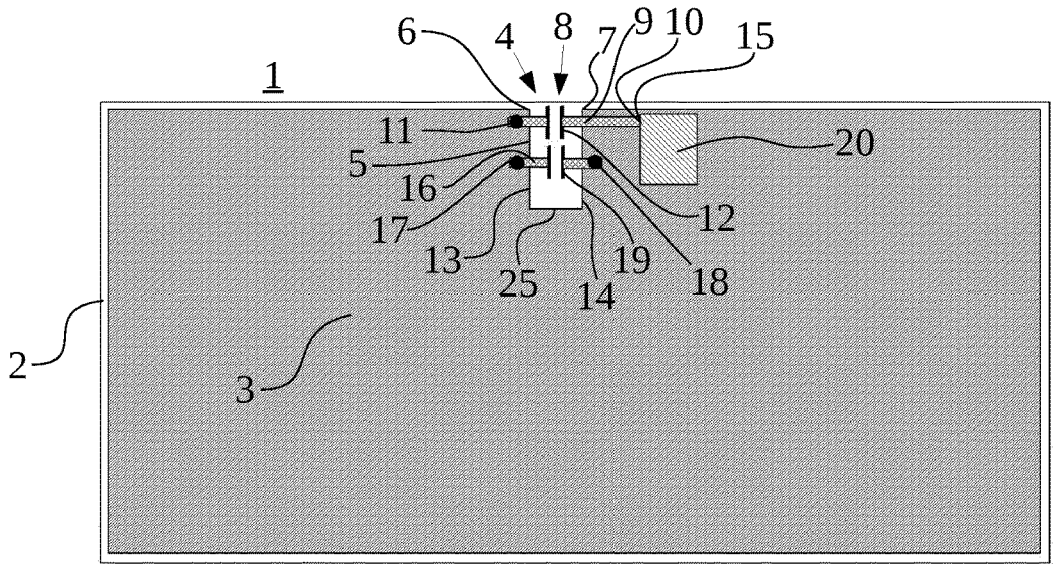
FIG. 4 illustrates an embodiment of the invention.

FIG. 4 depicts an exemplary antenna arrangement 1 according to the invention. The antenna arrangement 1 comprises a printed circuit board 2 having a metallised area 3 acting as a ground plane 3 in use. In an edge portion of the ground plane 3 a recess portion 4 is formed. The recess portion 4 comprises a first side 13 and a second side 14, that are opposite to each other. Further, the recess portion 4 comprises a bottom base side 25 connected to the first 13 and second 14 side to form a periphery 5 of the recess portion 4 ending in two points 6,7 that form an opening 8 of the recess portion 4 in the edge portion of the ground plane 3.

The antenna arrangement 1 further comprises a first electrically reactive network 9 with two ports 10, 11 comprising a lump series capacitor component 12 there between, wherein the first reactive network 9 is bridging the recess portion 4 and having one port 11 electrically connected to the ground plane 3 on the first side 13 of the recess portion 4, and the other port 10 providing a radio signal feedpoint 15 at the second side 14 of the recess portion 4. In general, the first electrically reactive network 9 according to this invention, except from the port 11 that is connected to the ground plane, is electrically isolated from the ground plane 3. However, it is possible to have some theoretical electrical connection to ground by means of some component having e.g. a reactive value that does meaningfully alter the characteristics of the antenna arrangement according to the invention.

Further, the antenna arrangement 1 comprises a second electrically reactive network 16 with two ports 17, 18 comprising a lump series capacitor component 19 there between. The second reactive network 16 is bridging the recess portion 4, separately from the first electrically reactive network 9, with one port 17 of the second network 16 electrically connected to the ground plane 3 on the first side 13 of the recess portion and another port 18 of the second network 16 electrically connected to the ground plane 3 on the second side 14 of the recess portion 4.

The antenna arrangement 1 is configured to resonate as an antenna with a resonance frequency when a radio circuit 20 for transmission and/or reception of radio waves is connected to the feed point 15 and is receiving or transmitting radio waves at the resonance frequency.

An electrical length of the recess portion 4, defined as the physical length from the opening 8 to a point on the periphery 5 of the recess portion 4 lying the farthest away from the opening 8 without crossing any ground plane 8 metal, is 1/10th of a wavelength of the resonance frequency of the antenna arrangement 1 or less.

Further, a physical distance between the first 9 and second 16 electrically reactive networks 9, 16 is less than 1/12 of a wavelength of the resonance frequency of the antenna arrangement 1. As an example, this physical distance can be seen in FIG. 4: the network 9 comprising a capacitor 12 and the network 16 comprising the capacitor 19 both extend in the horizontal direction in the figure. The physical distance between them is simply the length of the shortest possible line starting somewhere on the network 9 and ending somewhere on the network 16. (In FIG. 4 that is a line starting on network 9 and extending perpendicularly to that network 9 until it hits network 16.) This quality of the antenna arrangement is one thing that sets it apart from an IFA antenna with a top load: the distance between the network 9 and the feed 16 is much smaller than is possible in an IFA. Of course, this enables a much smaller design of the antenna arrangement, for a given frequency, compared to such an IFA.

Figure 5:
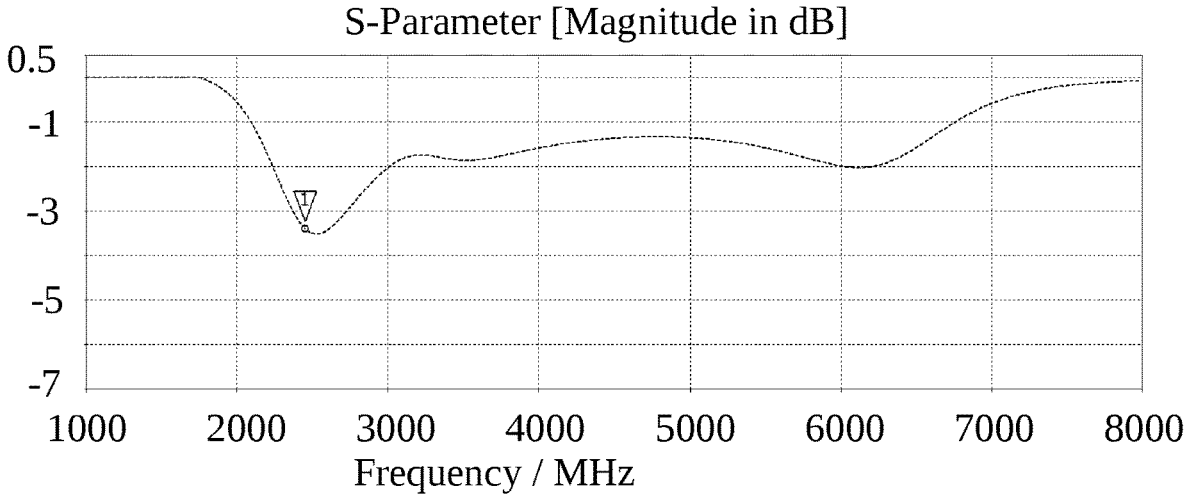
FIG. 5 illustrates a return loss of FIG. 4 in a dual band configuration.

In a study, the embodiment in FIG. 4 was configured to have a height of 6 mm and a width of 2 mm. Further, the capacitor 12 was set to 0.5 pF and the capacitor 19 was set to 0.2 pF. The resulting performance of this embodiment can be studied in FIG. 5, which illustrates the return loss. As can be seen, a resonance is had at 2.4 GHz and around 6 GHz. The scatter is quite high, but may be adequate in some applications.

In a further study, the embodiment in FIG. 4 was configured to have a height of 6 mm and a width of 2 mm as in the previous paragraph. The capacitor 12 was set to 0.3 pF and the capacitor 19 was set to 0.6 pF. The resulting performance of this embodiment can be studied in FIG. 6, which illustrates the return loss. As can be seen, a single band antenna is achieved with a very good resonance at 2.4 GHz even though the recess portion 4 only has a height of 6 mm.

In further embodiment of the antenna arrangement 1 according to the invention, the recess portion 4 can have a shape with the base side 25 being as long as the height of the recess portion 4 or longer. The height of the recess portion is defined as the length of the shortest path between the bottom base side 25 and the opening 8. With the proportions of the recess portion 4 configured this way, it has been noticed that it is possible to expand the bandwidth around the resonance frequency compared to a recess portion 4 that is has a height that is longer than the length of its width.

Figure 6:
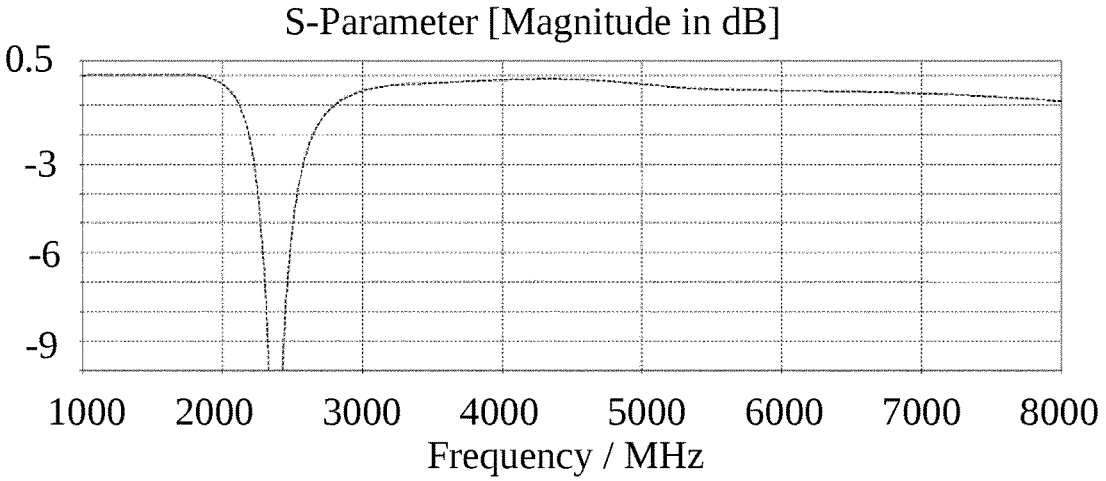
FIG. 6 illustrates a return loss of FIG. 4.

A further variation to the geometry of the recess portion 4 of the antenna arrangement 1 according to any previous embodiment of the invention, is where the shape of the recess portion 4 is triangular with the opening 8 of the recess portion 4 at one vertex of the triangle shape. This can be studied in FIG. 7. The triangular shape allows for a further decrease in the height of the recess portion 4, facilitating the inclusion of this antenna arrangement in very tight spaces. The performance of the FIG. 7 antenna arrangement is illustrated in FIG. 8, which depicts the return loss of the embodiment in FIG. 7. In this case the dimensions of the antenna arrangement 1 in FIG. 7 were a height of 3.5 mm and a breadth at the base side 25 of 8 mm at a resonance frequency of 2.4 GHz. As can be seen in FIG. 8, the bandwidth around the resonance frequency is substantially the same even though the height is considerably smaller than the height of the aforementioned embodiment shown in FIG. 4: 3.5 mm compared to 6 mm. The optimum impedance match of the FIG. 4 design may be a little bit better than the FIG. 7 design, as seen in FIGS. 6 and 8. However, broadly speaking, the bandwidth and impedance match of the FIG. 7 design is on a par with that of FIG. 4 while providing a design that has a height that is radically smaller than that of the antenna arrangement according to FIG. 4.

Figure 7:
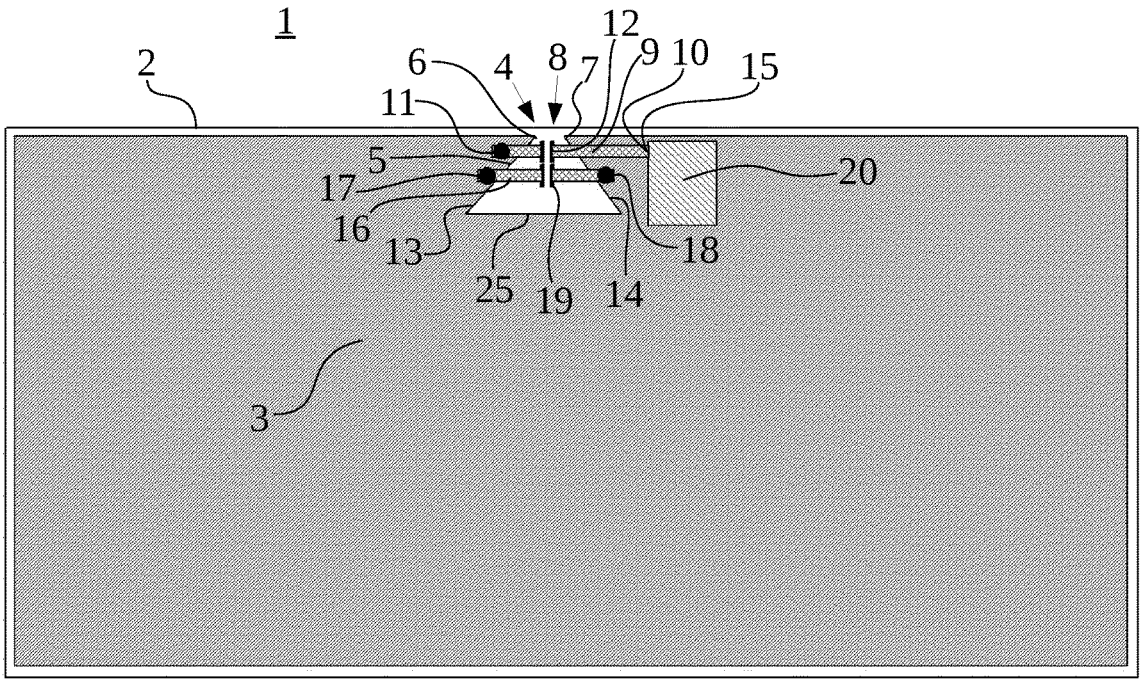
FIG. 7 illustrates a further miniaturized embodiment of the invention with altered geometrical shape.
Figure 8:
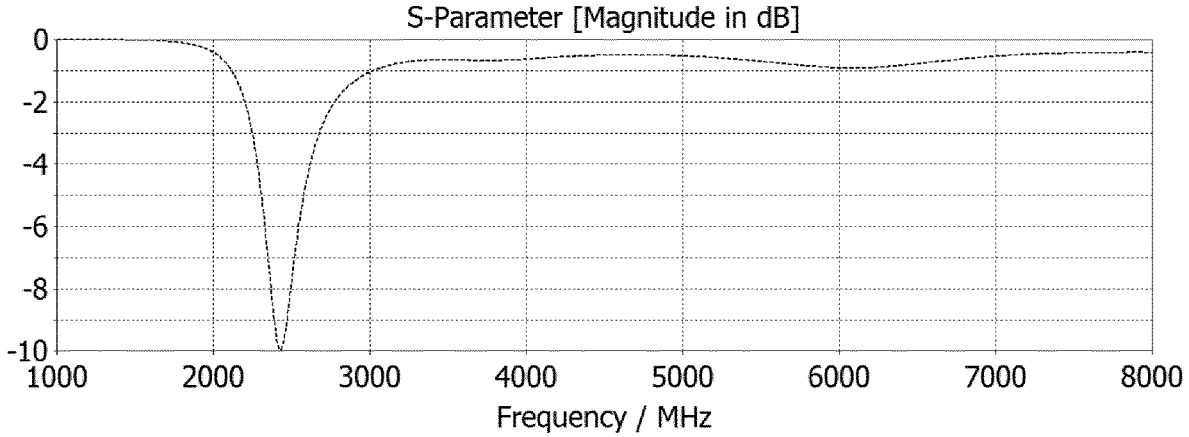
FIG. 8 illustrates a return loss of FIG. 7.
Figure 9:
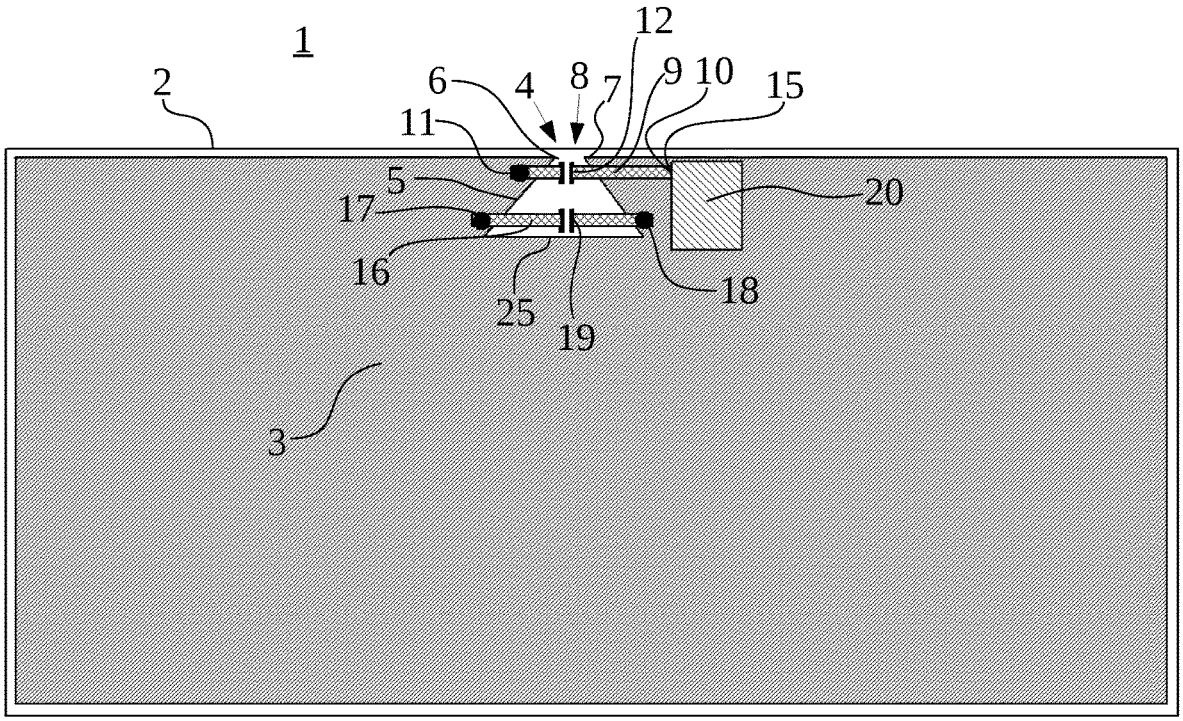
FIG. 9 illustrates an alternative placement of a reactive network.
Figure 10:
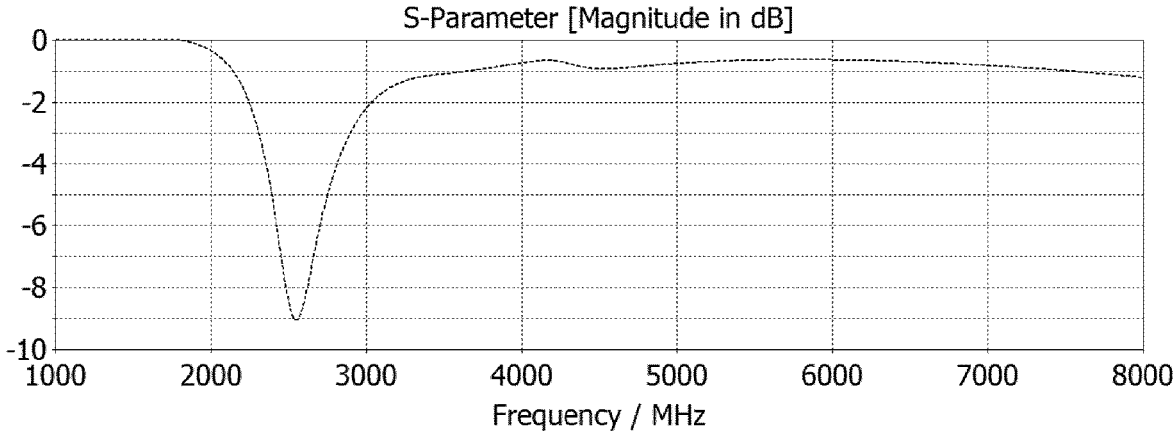
FIG. 10 illustrates a return loss of FIG. 9.

FIG. 9 depicts a variation of the embodiment of FIG. 7 in order to illustrate what happens when the position of the electrically reactive network 16 is varied. Specifically, in FIG. 9, the network 16 has been transferred to close to the base side 25 of the recess 4. In FIG. 7, the network 16 was positioned closer to the network 9 and approximately in the middle of the recess portion 4. The resulting performance of the embodiment in FIG. 9 can be seen in FIG. 10. All specifications of the antenna arrangement in FIG. 9 are the same as the one in FIG. 7 except the different placement of the network 16. As can be seen in FIG. 10, the varying of the placement of the network 16 yields an even better bandwidth compared to the network 16 placement in FIG. 7, at the expense of a slightly worse reflection coefficient for the antenna arrangement in FIG. 9. Thus, if an even better bandwidth is required, the network 16 can be moved in this way.

Figure 11:
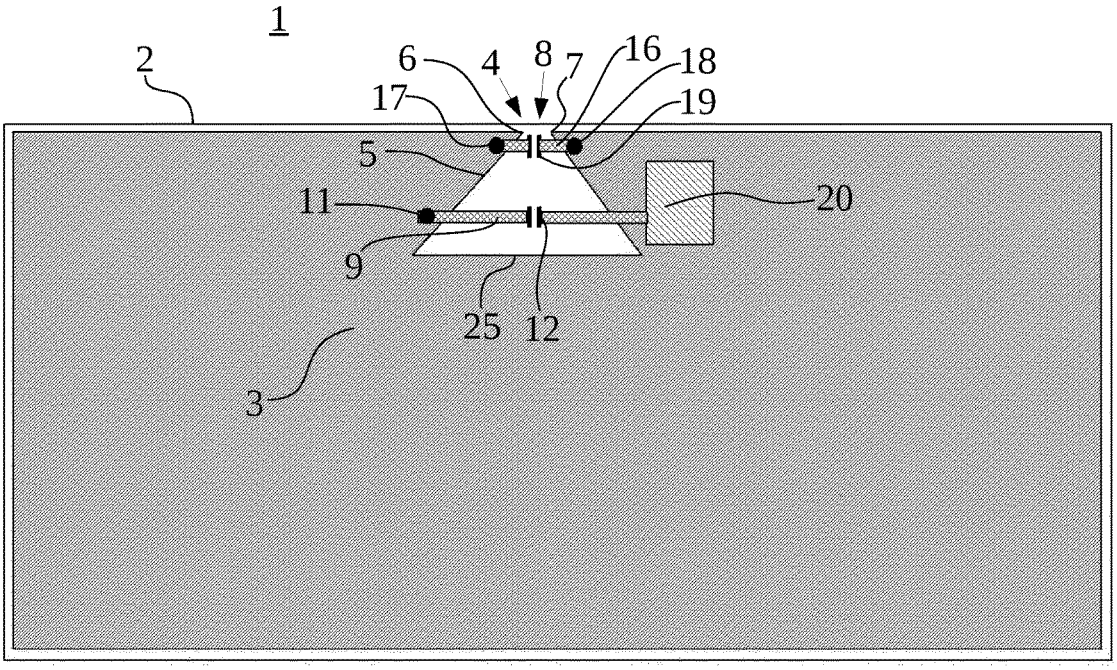
FIG. 11 illustrates an embodiment of the invention with dual band operation.

In view of the placement of the second electrically reactive network 16, it turns out that there is a lot of leeway. The second electrically reactive network 16 of the antenna arrangement 1 according to the invention could for instance be situated closer to the opening 8 of the recess portion 4 than the first electrically reactive network 9, as seen in FIG. 11. Thus, this flexible placement of the second electrically reactive network 16 allows for more options when for instance tweaking the resonance frequency or the impedance match of the antenna arrangement according to the invention compared to for instance a shunt capacitor at the antenna feed point of some of the prior art.

As has been mentioned, the antenna arrangement 1 according to any of previous embodiments of the present invention can be configured to resonate as an antenna with a further resonance frequency when a radio circuit 20 for transmission and/or reception of radio waves is connected to the feed point 15 and is receiving or transmitting radio waves at the further resonance frequency. Compared to single band, a slightly larger area of the notch, e.g. deeper and wider is required for dual band operation of the antenna arrangement according to the invention.

Figure 12:
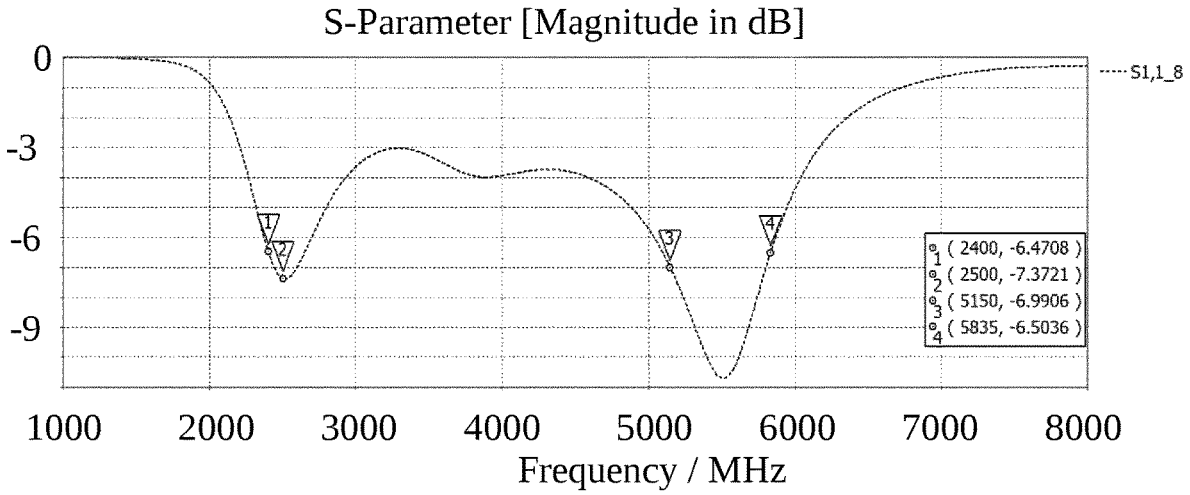
FIG. 12 illustrates a return loss of FIG. 11.

A particularly advantageous configuration of an antenna arrangement according to the invention working in dual mode has been found when the antenna arrangement is configured for dual band operation (for instance by tweaking the area of the recess portion) and the second electrically reactive network 16 of the antenna arrangement 1 according to the invention is situated closer to the opening 8 of the recess portion 4 than the first electrically reactive network 9. The performance of such a dual band configuration of the antenna arrangement according to the invention in FIG. 11 can be studied in FIG. 12. FIG. 12 illustrates the return loss of FIG. 11 when the antenna arrangement in FIG. 11 was configured with a recess portion that has a height of 5.5 mm and a width at the base side 25 of 10 mm. As can be seen, this configuration is beneficial for dual band operation.

When designing such a dual band antenna, the network 9 mostly influences the resonance frequency in the 2.4 GHz band and the network 16 mostly influences the resonance frequency in the 5 GHz band. The network 16 also affects the impedance matching of the 2.4 GHz band. The area of the void/portion of the recess portion 4 that lie between the two networks and the area of the void between network 9 and the bottom side 25 in FIG. 11 also affects the resonance frequency. If the network 9 is moved downwards, the lower frequency of the dual band configuration (in this case a baseline 2.4 GHz) will increase. The upper resonance frequency (in this case the baseline 5 GHz) will decrease. However, the position of the feeding network 9 can not be moved wildly around, but has to be kept within a tolerance area where the dual band configuration is having favourable characteristics. This tolerance area has to be experimentally established depending on the specific geometry of the recess portion 4/notch.

One thing that distinguishes the antenna arrangement 1 according to the present application, with the second electrically reactive network 16, from some prior art that is using a shunt capacitor at the feed for impedance matching, is that the reactance of the second electrically reactive network 16 can be quite high. For all embodiments of the invention is possible to have an impedance that is higher than 100Ω as measured at a frequency of operation of the antenna arrangement 1. This facilitates impedance matching of the antenna arrangement according to the invention without short-circuiting a potential upper band of the antenna arrangement contrary to the shunt capacitor at the feed portion of prior art. Thus, this design according to the present invention also allows for a potential upper band/a dual band design.

The antenna arrangement of the present invention can be provided in many ways. For instance, it could be occupying a main board together with any radio circuitry or it could be provided as a standalone board. In any case, when put to use, the antenna arrangement 1 according to the invention would also comprise a radio circuit 20 for transmission and/or reception of radio waves connected to the feed point 15. Such a radio circuit 20 would then have at least one resonance frequency on which reception and/or transmission would occur.

As an example of suitable values for the capacitances of the present invention, the antenna arrangement 1 according to the invention could have a series capacitance of the first electrically reactive network 9 in a range between 0.1 pF to 0.8 pF, preferably between 0.2 pF and 0.5 pF. The series capacitance of the second electrically reactive network 16 could be in a range between 0.05 pF to 0.6 pF, preferably between 0.07 pF and 0.4 pF. With these capacitance values, and a suitable size of the recess portion as elaborated on elsewhere in this document, the antenna arrangement 1 is suitable for operation in a range between 2 GHz to 6 GHz.

It could be worth to mention specific values for a specific embodiment of a single band antenna according to the invention. This antenna arrangement 1 according to the invention has a series capacitance of the first electrically reactive network 9 of about 0.3 pF and a series capacitance of the second electrically reactive network 16 of about 0.2 pF. The height of the recess portion is 3.5 mm and the breadth of the base side 25 is 8 mm. This yields a resonance frequency of around 2.4 GHz. The height of the recess portion is defined as the length of the shortest path between the bottom base side and the opening 8. This embodiment substantially corresponds to the one in the previously described FIG. 7.

As an example of an antenna arrangement according to invention having a dual band characteristic, the series capacitance of the first electrically reactive network 9 could be in the range of 0.2 to 0.4 pF. Further, the series capacitance of the second electrically reactive network 16 could be about 0.07 pF. The height of the recess portion is 5.5 mm and the breadth of the base side 25 is 10 mm. This yields a resonance frequency of around 2.4 GHz and a further resonance frequency of around 5 GHz. As before, the height of the recess portion is defined as the length of the shortest path between the bottom base side 25 and the opening 8. This embodiment substantially corresponds to the one in the previously described FIG. 11.

More generally, in order to design an antenna arrangement according to the present invention, some embodiment described in this document could be used as a starting point and then be scaled, for instance to the desired frequency. So, if a particular original design has a height of 7.8 mm for a certain resonance frequency and a desired resonance frequency of a new design is half the original design, the height of the new design could be taken to be double the original design. Also, the capacitances of the original design could be doubled in the new design. This new design could provide as a first approximation of the new design, which of course could be tweaked further to achieve the desired characteristics.

When it comes to matching of the impedance of a regular antenna in the art, normally matching involves setting up the generator feed, checking the characteristic of the set up and then connecting components, such as a capacitive shunt, to the generator feed to match it to a desired system impedance.

However, for the present invention, matching has to be done in a different, more ad hoc way, since the second electrically reactive network 16 is not directly connected to the feed point. Variables to adjust comprises for instance: the size of the recess portion, the geometry of the recess portion, the capacitance of the first and second electrically reactive networks 9, 16, the placement of the networks across the recess portion and the mutual physical distance between the networks 9, 16. This ad hoc matching makes the surprising quality of the present invention all the more apparent, since, normally, the skilled person in the art would use the conventional impedance matching procedure when tuning an antenna design and would therefore not stumble upon the design of the present invention.

The antenna arrangement 1 according to any of the previous embodiments would typically be employed in a device of some sort. For instance in cars, mobile phones, tablets, sensors or any other device where radio connectivity is needed and the size of the antenna has to be small.

Figure 13:
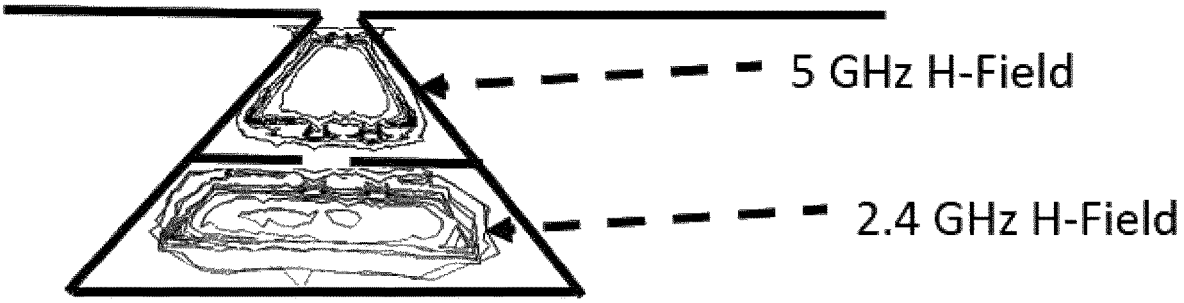
FIG. 13 illustrates a schematic of dual band magnetic field generation.

One advantage of the invention in dual band operation is that the voids between the electrically reactive networks of the antenna arrangement according to the invention, which voids can be seen in FIG. 13, each contributes substantially solely to the characteristics of a frequency band of their own. For instance, in FIG. 13, the 5 GHz H-field of the antenna arrangement can be seen to emanate from the upper void of the triangular antenna arrangement, whereas the 2.4 GHz H-field mostly emanates from the bottom void. This implies that in order to modify the characteristics of one of the bands, only one of the voids must be modified. Conversely, modifying one of the voids to affect the characteristics of one of the frequency bands does not effect the other band. Thus, it is quite straightforward to tune the antenna arrangement according to the invention to a dual band configuration in this sense.

Figure 14:
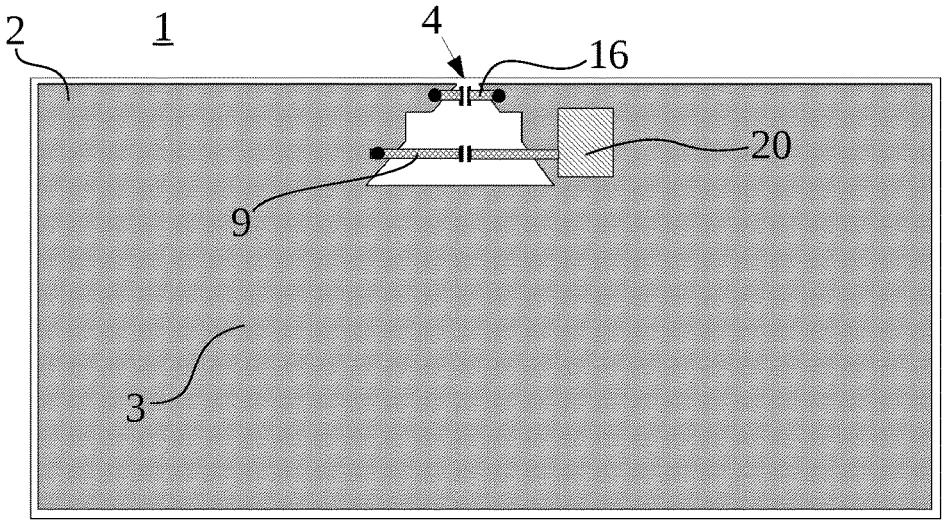
FIG. 14 illustrates a modified geometry according to the invention.
Figure 15:
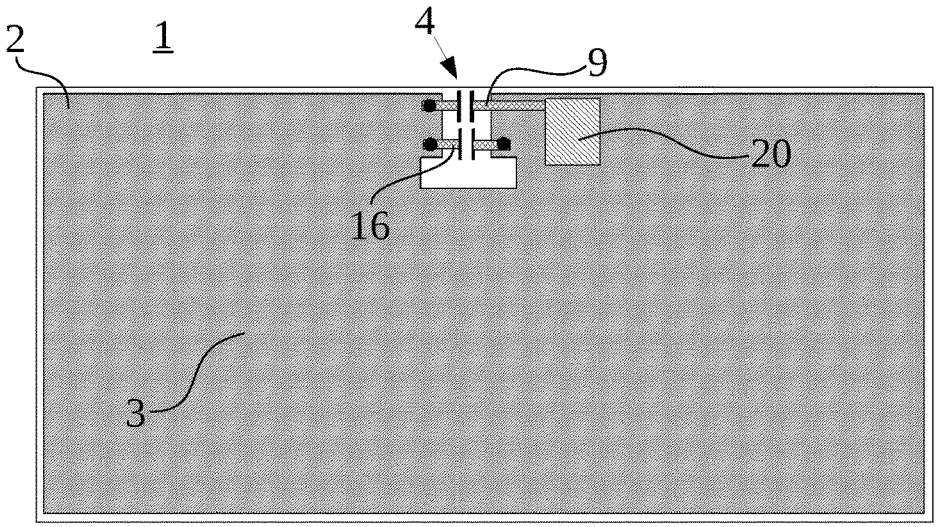
FIG. 15 illustrates an alternative geometry of the invention.

Other variations of the antenna arrangement according to the invention are also possible. For instance, FIGS. 14 and 15 illustrate that the geometry of the recess portion does not have to be rectangular or triangular, but can also have other geometries. For any geometry, the size of the capacitances of the networks 9, 16 has to be tuned to achieve the desired properties of the antenna arrangement.

Another variation of the antenna arrangement according to the invention could comprise a third electrically reactive network in addition to the previous two. Such a third electrically reactive network could have two ports and also comprises a lump series capacitor component there between. In a way similar to the second reactive network 16 described previously, the third reactive network could bridge the recess portion of the invention separately from the first and second electrically reactive networks. One port 22 of the third network 21 would be electrically connected to the ground plane on the first side of the recess portion and another port of the second network would be electrically connected to the ground plane on the second side of the recess portion. In this way, further fine tunings of the antenna arrangement according to the invention is possible.

It should be noted that the antenna arrangement according to the present invention is a magnetic antenna. That is, this antenna "prefers" locations with a high magnetic field: it is working best when it is located away from the corners of a ground plane/printed circuit board. The preferred location is at the middle of the longest side of the ground plane.

Since the antenna arrangement according to present invention is a magnetic type antenna, it does not require a recess portion that cuts deep into the Printed Circuit Board (PCB) for its operation.

For the antenna arrangement according to the invention, the physical depth of the recess portion 4 into the printed circuit board along a direction of the printed circuit board could be 25% or less of the depth of the printed circuit board 2 in the same direction with good performance. This is an attractive property since the inner PCB area is very valuable for other circuitry and components.

The present invention is also applicable for other communication standards and frequencies than the 2.4 and 5 10 GHz presented. It can be used for GPS, Glonass or other positioning systems. It can be used for cellular communication. It can be used for antennas at ISM bands and other single or dual band systems.

Figure 16:
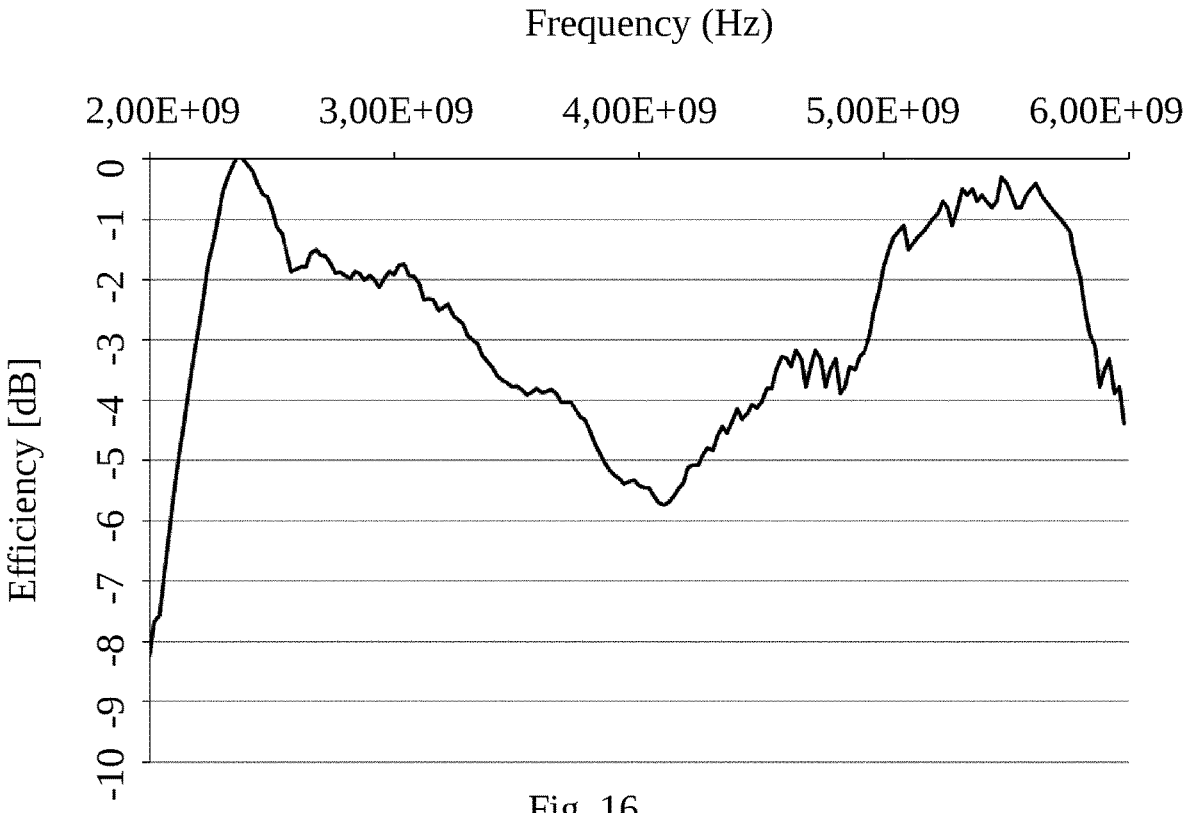
FIG. 16 illustrates a radiation efficiency of FIG. 11.

Returning to the antenna in FIG. 11, it is interesting for a further reason. When it comes to antennas, the really crucial characteristic is the radiation efficiency. That is, the measured, real world performance of the antenna (measured in for instance an antenna lab). FIG. 16 depicts this performance, the radiation efficiency, for the antenna in FIG. 11 and it turns out that it is surprisingly high for such an antenna.

As has been mentioned above, the antenna of FIG. 11 has a recess portion with a height of 5.5 mm and a width at the base side 25 of 10 mm. At this size and drive frequencies, an antenna can be defined to be a small antenna. In Wheeler, H., "Fundamental limitations of small antennas", Proc. IRE, vol. 35, no. 12, pp. 1479-1484, 1947, a "small antenna" is defined as being smaller than $\lambda/(2*\pi)$. At this size and below, the performance of an antenna is severely affected.

Electrically small antennas usually have very low efficiency compared to normally sized antennas. To get high efficiency they need to be placed on bigger objects, typically an electronic board with a copper layer. Then the electrically small "antenna" act more as an excitation element, getting significant contribution from the electronic board that emit the electromagnetic radiation. To work properly, the small antenna needs to have resonant properties at the desired frequency and enough bandwidth required together with good radiation efficiency. This is a big challenge when designing electrically small antennas.

The electrically small antenna can be seen as a resonant circuit with capacitive and inductive elements, reactive elements. The antenna structure needs to be implemented such that the reactive elements create a resonance with correct impedance and bandwidth. It is common to combine lumped elements together with a structure in the copper layer giving the desired property. When shrinking the antenna size it is difficult to have bandwidth and radiation efficiency good enough for the application.

Figure 17:
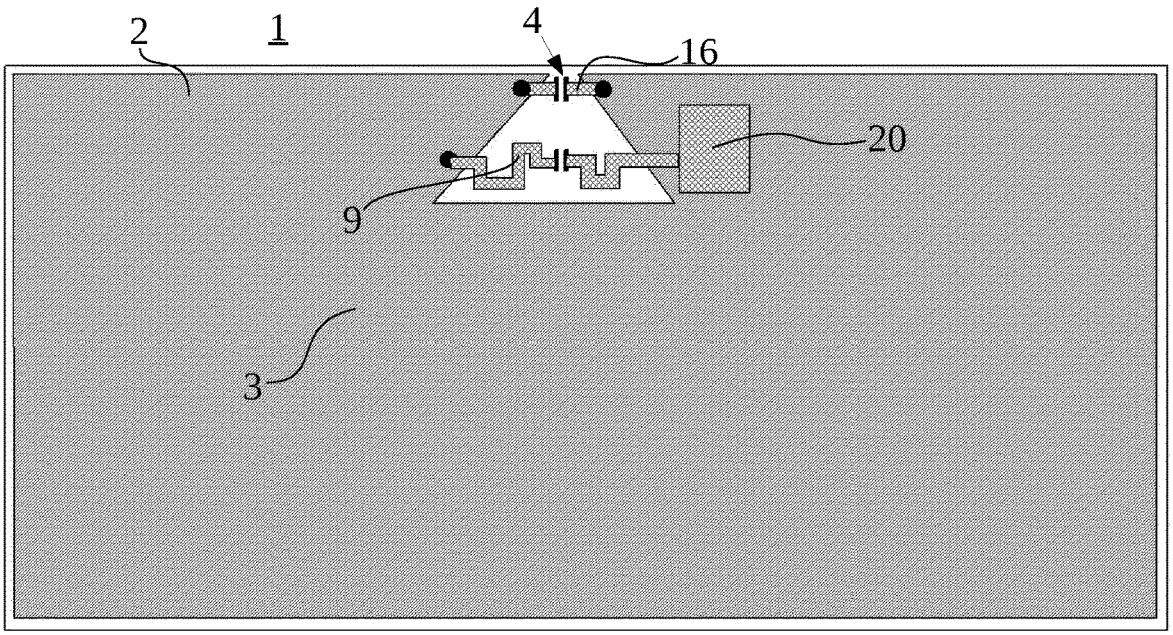
FIG. 17 illustrates an embodiment of the invention comprising a meandering line.

FIG. 17 illustrates a further embodiment of the invention. At least a part of an electric line of the first electrically reactive network 9 is in a meandering form. In the FIG. 17, it can be seen to be in a meandering form along the whole length of the network 9.

Figure 18:
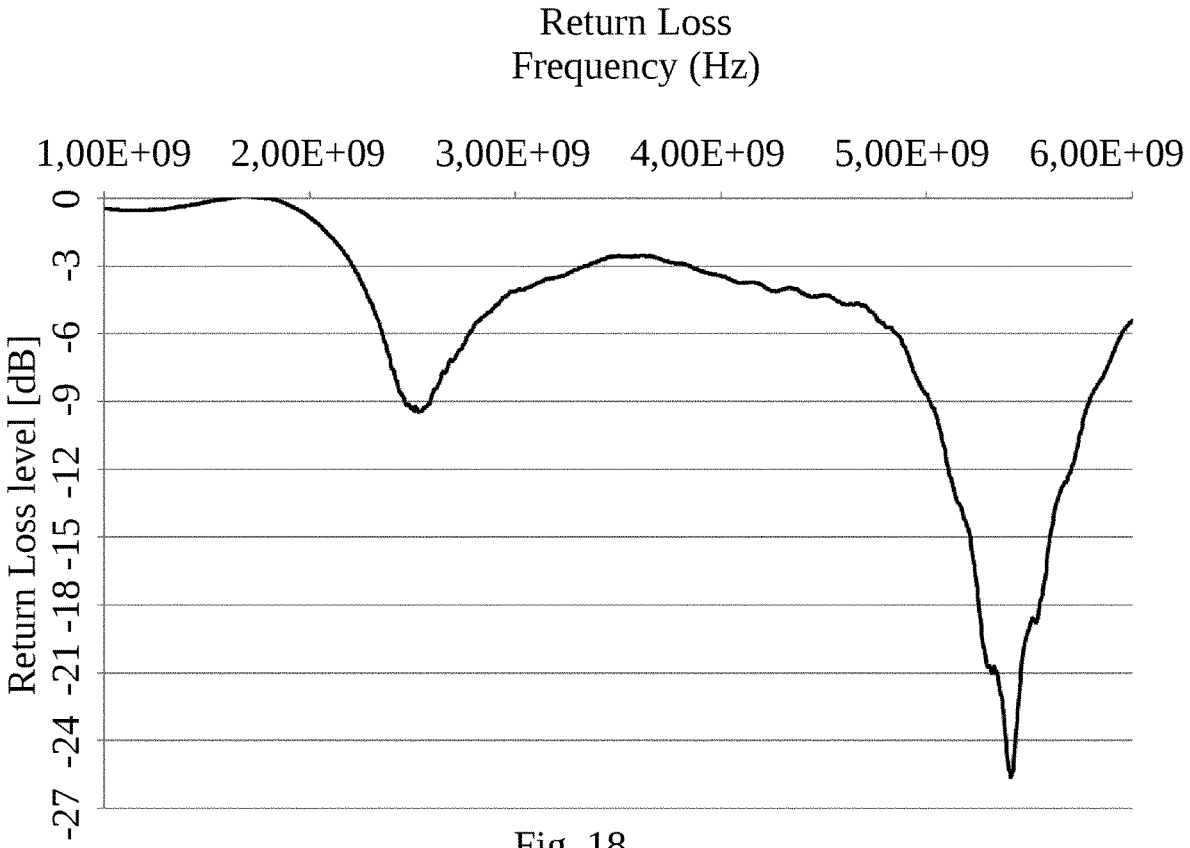
FIG. 18 illustrates a return loss FIG. 17.
Figure 19:
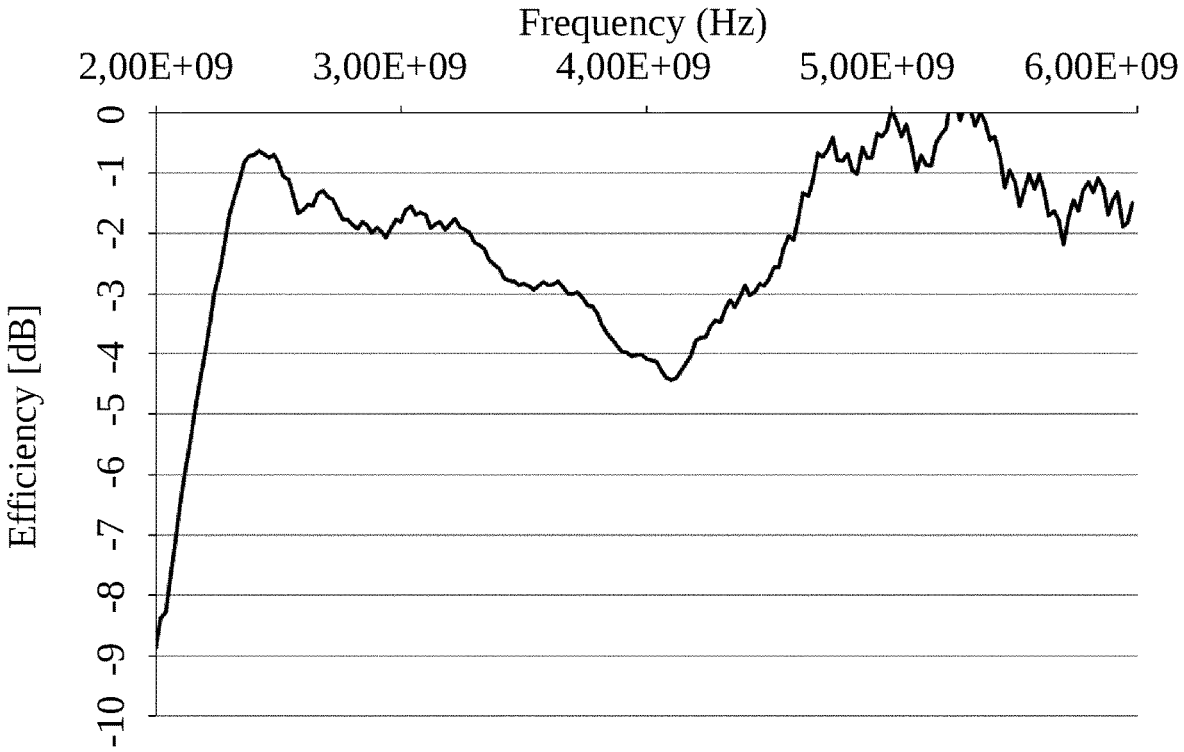
FIG. 19 illustrates a radiation efficiency of FIG. 17.

This meandering feature of the invention, as an example depicted in FIG. 17, brings an advantage in the form of an improved bandwidth. In FIG. 18, which depicts the return loss of the embodiment in FIG. 17, the bandwidth around 5-6 GHz can be seen to have improved in comparison with the bandwidth of the corresponding device without the meandering line seen in FIG. 11 (corresponding return loss diagram in FIG. 12). Also, as can be seen in FIG. 19, the corresponding radiation efficiency for this meandering line embodiment according to FIG. 17 is very high.

REFERENCE SIGNS LIST

1. Antenna arrangement
2. Printed circuit board
3. Ground plane
4. Recess portion

5. Periphery of recess portion
6. Point on periphery
7. Point on periphery
8. Opening
9. First electrically reactive network
10. Port of first reactive network
11. Port of first reactive network
12. Lump capacitor
13. First side of recess portion
14. Second side of recess portion
15. Radio signal feed point
16. Second electrically reactive network
17. Port of second reactive network
18. Port of second reactive network
19. Lump capacitor
20. Radio circuit
21. Third electrically reactive networks
22. Port of third reactive networks
23. Port of third reactive networks
24. Lump capacitor
25. Base side of recess portion
100. Radio circuitry
110. Electrically reactive network

The invention claimed is:

1. An antenna arrangement (1) comprising:

a printed circuit board (2) having a metalized (3) acting as a ground plane (3) in use, a recess portion (4) in an edge portion of the ground plane (3), which recess portion (4) comprises a first side (13) and a second side (14), that are opposite to each other, a bottom base side (25) connected to the first (13) and second (14) side to form a periphery (5) of the recess portion (4) ending in two points (6,7) that form an opening (8) of the recess portion (4) in the edge portion of the ground plane (3), a first electrically reactive network (9) with two ports (10,11) comprising a lump series capacitor component (12) there between, wherein the first reactive network (9) is bridging the recess portion (4) and having one port (11) electrically connected to the ground plane (3) on the first side (13) of the recess portion (4), and the other port (10) providing a radio signal feedpoint (15) at the second side (14) of the recess portion (4), a second electrically reactive network (18) with two ports (17,18) comprising a lump series capacitor component (19) there between, wherein the second reactive network (16) is bridging the recess portion (4), separately from the first electrically reactive network (9), with one port (17) of the second network (16) electrically connected to the ground plane (3) on the first side (13) of the recess portion and another port (18) of the second network (16) electrically connected to the ground plane (3) on the second side (14) of the recess portion (4), wherein the antenna arrangement (1) is configured to resonate as an antenna with a resonance frequency when a radio circuit (20) for transmission and/or reception of radio waves is connected to the feed point (15) and is receiving or transmitting radio waves at the resonance frequency, wherein an electrical length of the recess portion (4), defined as the physical length from the opening (8) to a point on the periphery (5) of the recess portion (4) lying the farthest away from the opening (8) without crossing any ground plane (8) metal, is 1/10th of a wavelength of the resonance frequency of the antenna arrangement (1) or less, and wherein a physical distance between the first (9) and second (16) electrically reactive networks (9,16) is less than 1/12 of a wavelength of the resonance frequency of the antenna arrangement (1), and characterized in that the shape of the recess portion (4) is triangular with the opening (8) of the recess portion (4) at one vertex of the triangle shape.

2. An antenna arrangement (1) according to claim 1, wherein the recess portion (4) has a shape with the base side being as long as a height of the recess portion (4) or longer, the height of the recess portion defined as the length of the shortest path between the bottom base side and the opening (8).

3. An antenna arrangement (1) according to claim 2, wherein the second electrically reactive network (16) is situated closer to the opening (8) of the recess portion (4) than the first electrically reactive network (9).

4. An antenna arrangement (1) according to claim 2, wherein the antenna arrangement (1) is configured to resonate as an antenna with a further resonance frequency when a radio circuit (20) for transmission and/or reception of radio waves is connected to the feed point (15) and is receiving or transmitting radio waves at the further resonance frequency.

5. An antenna arrangement (1) according to claim 2, wherein the reactance of the second electrically reactive network (16) is higher than 100Ω at a frequency of operation of the antenna arrangement (1).

6. An antenna arrangement (1) according to claim 2, comprising a radio circuit (20) for transmission and/or reception of radio waves connected to the feed point (15) and wherein the radio circuit (20) has at least one resonance frequency.

7. An antenna arrangement (1) according to claim 2, wherein the series capacitance of the first electrically reactive network (9) is in a range between 0.1 pF to 0.8 pF, preferably between 0.2 pF and 0.5 pF, and the series capacitance of the second electrically reactive network (16) is in a range between 0.05 pF to 0.6 pF, preferably between 0.07 pF and 0.4 pF, wherein the antenna arrangement (1) is suitable for operation in a range between 2 GHz to 6 GHz.

8. An antenna arrangement (1) according to claim 2, wherein the physical depth of the recess portion (4) into the printed circuit board along a direction of the printed circuit board is 25% or less of the depth of the printed circuit board (2) in the same direction.

9. An antenna arrangement (1) according to claim 2, wherein at least a part of an electric line of the first electrically reactive network (9) is in a meandering form.

10. Device comprising an antenna arrangement (1) according to claim 2.

11. An antenna arrangement (1) according to claim 1, wherein the second electrically reactive network (16) is situated closer to the opening (8) of the recess portion (4) than the first electrically reactive network (9).

12. An antenna arrangement (1) according to claim 1, wherein the antenna arrangement (1) is configured to resonate as an antenna with a further resonance frequency when a radio circuit (20) for transmission and/or reception of radio waves is connected to the feed point (15) and is receiving or transmitting radio waves at the further resonance frequency.

13. An antenna arrangement (1) according to claim 1, wherein the reactance of the second electrically reactive network (16) is higher than 100Ω at a frequency of operation of the antenna arrangement (1).

14. An antenna arrangement (1) according to claim 1, comprising a radio circuit (20) for transmission and/or reception of radio waves connected to the feed point (15) and wherein the radio circuit (20) has at least one resonance frequency.

15. An antenna arrangement (1) according to claim 1, wherein the series capacitance of the first electrically reactive network (9) is in a range between 0.1 pF to 0.8 pF, preferably between 0.2 pF and 0.5 pF, and the series capacitance of the second electrically reactive network (16) is in a range between 0.05 pF to 0.6 pF, preferably between 0.07 pF and 0.4 pF, wherein the antenna arrangement (1) is suitable for operation in a range between 2 GHz to 6 GHz.

16. An antenna arrangement (1) according to claim 15, wherein the series capacitance of the first electrically reactive network (9) is about 0.3 pF and the series capacitance of the second electrically reactive network (16) is about 0.2 pF, a height of the recess portion is 3.5 mm, a breadth of the base side 25 is 8 mm, at a resonance frequency of around 2.4 GHz, wherein the height of the recess portion is defined as the length of the shortest path between the bottom base side and the opening (8).

17. An antenna arrangement (1) according to claim 15, wherein the series capacitance of the first electrically reactive network (9) is in the range of 0.2 to 0.4 pF and the series capacitance of the second electrically reactive network (16) is about 0.07 pF, a height of the recess portion is 5.5 mm, a breadth of the base side 25 is 10 mm, at a resonance frequency of around 2.4 GHz and a further resonance frequency of around 5 GHz, wherein the height of the recess portion is defined as the length of the shortest path between the bottom base side (25) and the opening (8).

18. An antenna arrangement (1) according to claim 1, wherein the physical depth of the recess portion (4) into the printed circuit board along a direction of the printed circuit board is 25% or less of the depth of the printed circuit board (2) in the same direction.

19. An antenna arrangement (1) according to claim 1, wherein at least a part of an electric line of the first electrically reactive network (9) is in a meandering form.

20. Device comprising an antenna arrangement (1) according to claim 1.

* * * * *